US006739988B2

(12) United States Patent
Jensen et al.

(10) Patent No.: US 6,739,988 B2
(45) Date of Patent: May 25, 2004

(54) PORTABLE RECOIL WALL

(75) Inventors: Donald R. Jensen, Penn Yan, NY (US); Steven R. Trombley, Bluff Point, NY (US); Tseng Chun Ming, Taichung (TW)

(73) Assignee: Brine, Inc., Milford, MA (US)

( * ) Notice: Subject to any disclaimer, the term of this patent is extended or adjusted under 35 U.S.C. 154(b) by 0 days.

(21) Appl. No.: 10/175,300

(22) Filed: Jun. 19, 2002

(65) Prior Publication Data

US 2003/0236139 A1 Dec. 25, 2003

(51) Int. Cl.[7] ..... A63B 69/00
(52) U.S. Cl. ..... 473/435; 273/396
(58) Field of Search ..... 473/434, 197, 473/469, 383, 435; 273/400, 395, 595, 410, 396; 256/26

(56) References Cited

U.S. PATENT DOCUMENTS

| | | | | |
|---|---|---|---|---|
| 3,456,945 A | * | 7/1969 | Epply | 473/435 |
| 3,580,570 A | | 5/1971 | Fenner et al. | |
| 3,836,144 A | * | 9/1974 | Mahoney | 473/435 |
| 5,833,234 A | * | 11/1998 | Vavala et al. | 473/434 |
| 6,110,074 A | | 8/2000 | Tacquet | |
| 6,190,270 B1 | | 2/2001 | Barry | |
| 6,237,169 B1 | * | 5/2001 | Ying | 5/111 |

* cited by examiner

*Primary Examiner*—Gregory Vidovich
*Assistant Examiner*—M. Chambers
(74) *Attorney, Agent, or Firm*—Foley Hoag LLP

(57) ABSTRACT

A portable recoil wall for sports ball practice. In one embodiment, the recoil wall may include a target that is resiliently suspended on a foldable frame which may be supported in a plurality of inclined positions by a collapsible sustaining assembly coupled to the frame. A portable recoil target, capable of being removably attached to other structures such as netted goals and the like are also disclosed.

22 Claims, 16 Drawing Sheets

PORTABLE RECOIL WALL

BACKGROUND OF THE INVENTION

In many sports, considerable skill is required for catching and throwing a ball either by hand as in, for example, the sport of volleyball, or with an implement, such as a racquet in tennis or a stick in lacrosse. Typically, a player practices by tossing the ball back and forth with another player or by tossing the ball against the side of a building or cement wall to play what is known as wall ball. Such practice is often not convenient and may not be available when and where needed. Thus, there is a need for a recoil wall for practicing throwing skills and that is relatively easy to assemble, portable and inexpensive to manufacture.

SUMMARY OF THE INVENTION

One embodiment of the invention is directed to a portable recoil wall for ball practice that may include a target resiliently supported on a foldable frame that is supportable in a plurality of inclined positions by a collapsible sustaining assembly that is coupled to the frame.

Another embodiment may comprise a recoil target that may be removably attached to a structure such as, for example, a netted lacrosse goal. The recoil target may have a foldable frame that may be moved between an extended position wherein a target sheet is centrally and resiliently disposed in a central opening defined by the frame and a second folded position. At least one clamping assembly may be provided to removably clamp the target to a portion of the goal.

BRIEF DESCRIPTION OF THE DRAWINGS

In the accompanying Figures, there are shown present embodiments of the invention wherein like reference numerals are employed to designate like parts and wherein.

DETAILED DESCRIPTION OF EMBODIMENTS OF THE INVENTION

Figure 1:
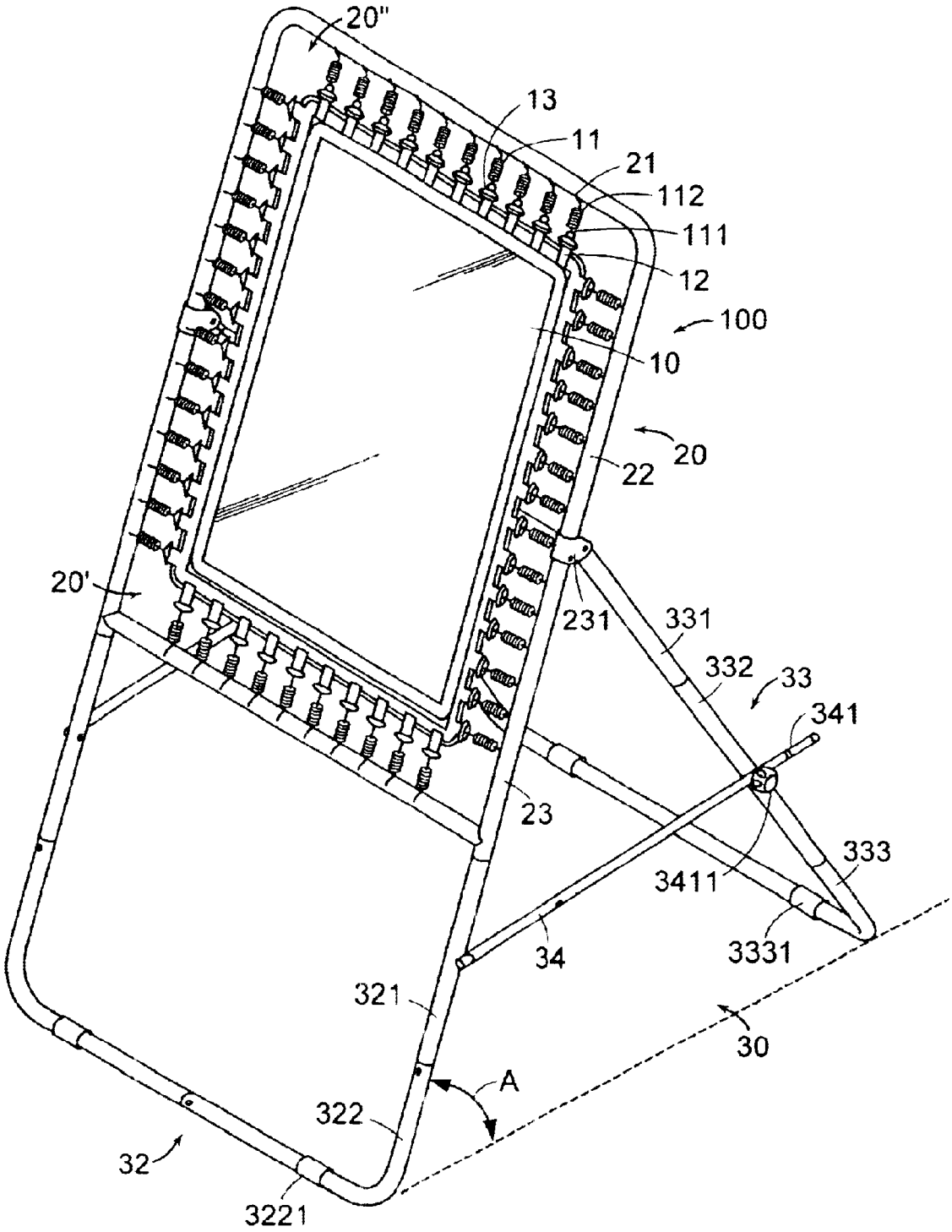
FIG. 1 is a is a front and right side isometric view of an embodiment of the recoil wall of the present invention.

Referring now to the drawings for the purpose of illustrating the invention and not for the purpose of limiting the same, it is to be understood that standard components or features that are within the purview of an artisan of ordinary skill and do not contribute to the understanding of the various embodiments of the invention are omitted from the drawings to enhance clarity.

Figure 2:
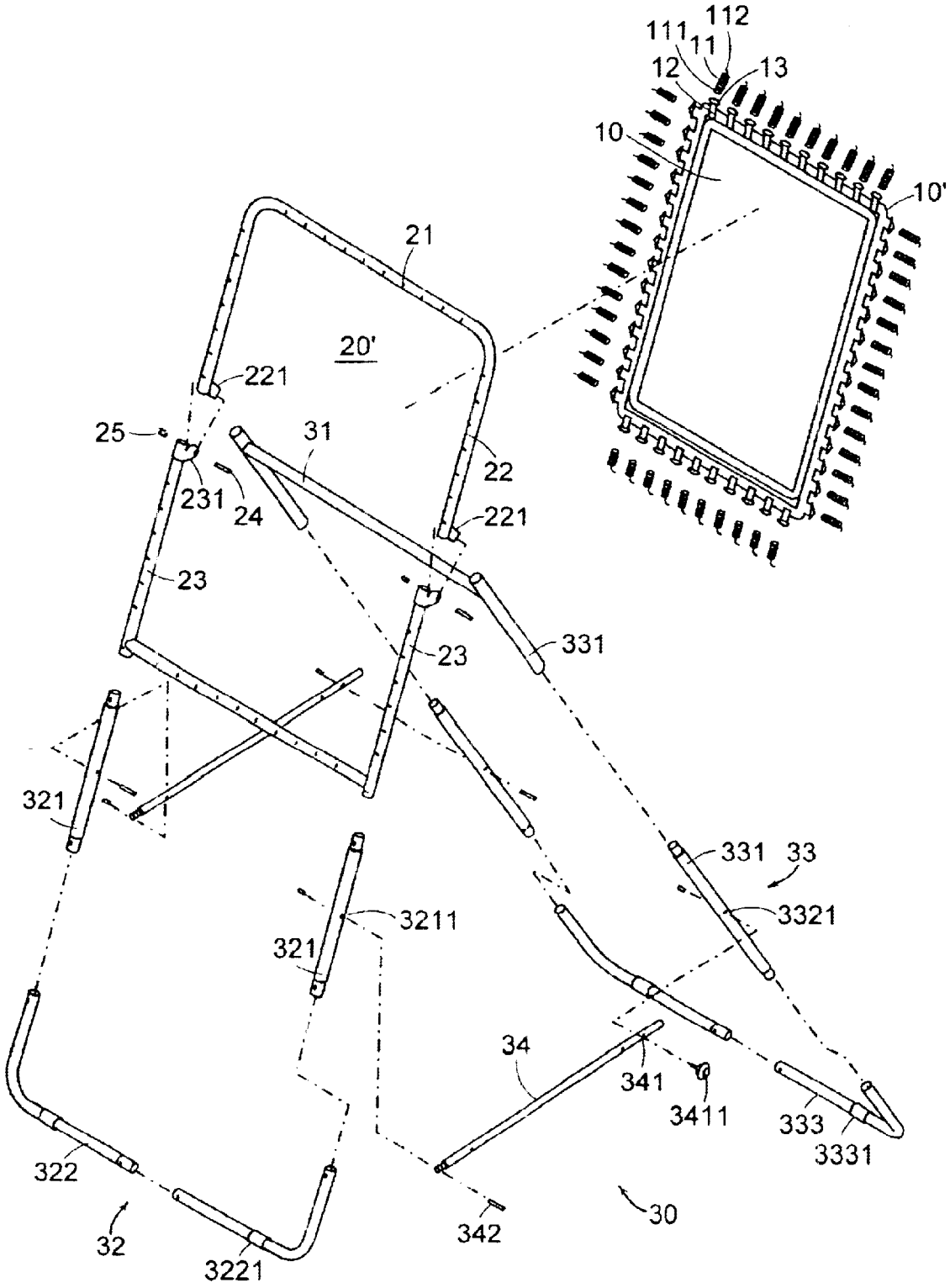
FIG. 2 is an exploded perspective view of the recoil wall of FIG. 1.
Figure 3:
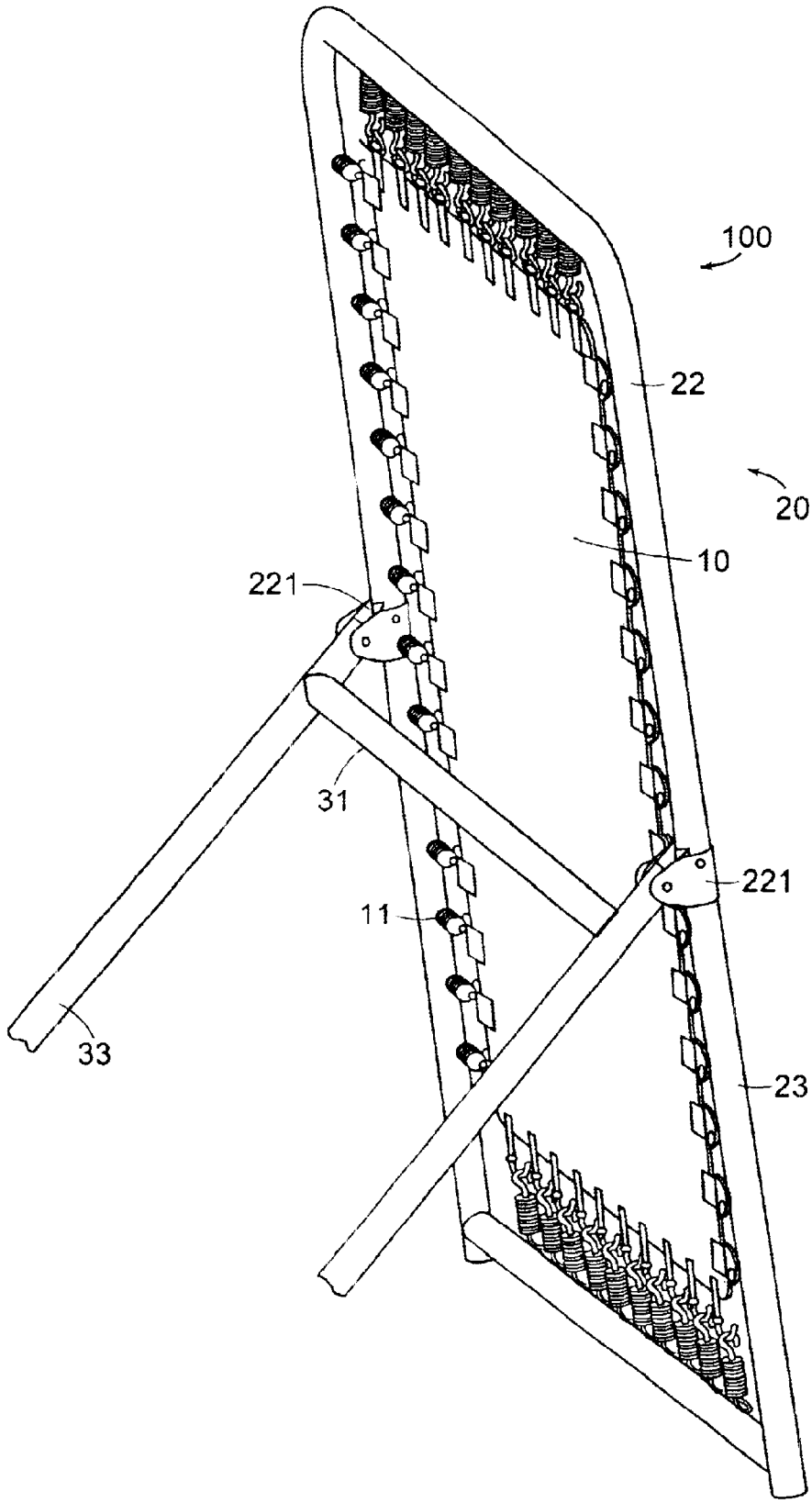
FIG. 3 is a rear isometric view of the recoil wall of FIG. 1.

With reference to FIGS. 1–3 of the drawings, an embodiment of the portable recoil wall 100 may comprise a target 10, a frame 20 and a sustaining assembly 30. The target 10 may be made of elastic cloth having a relatively high tensile modulus that further facilitates the return of the ball to the player. For example, target 10 may be fabricated from a woven nylon material or other materials that have similar elastic properties. It is also conceivable, however, that the target 10 may be fabricated from a variety of different materials, including materials that are rigid or semi-rigid depending upon the degree of resiliency required by the user. Also, in one embodiment, the target 10 may include a plurality of projections 12 that may be evenly spaced around the periphery of the target 10. Each of the projections 12 may comprise a flap that may be integrally formed around the periphery of the target 10 or attached thereto by, for example, sewing or other fastening methods and devices. Clamps, hooks, elasticized bands, etc. could also be used. Each projection may also include a retaining ring 13 for connection to the frame 20 as will be described below.

Figure 4:
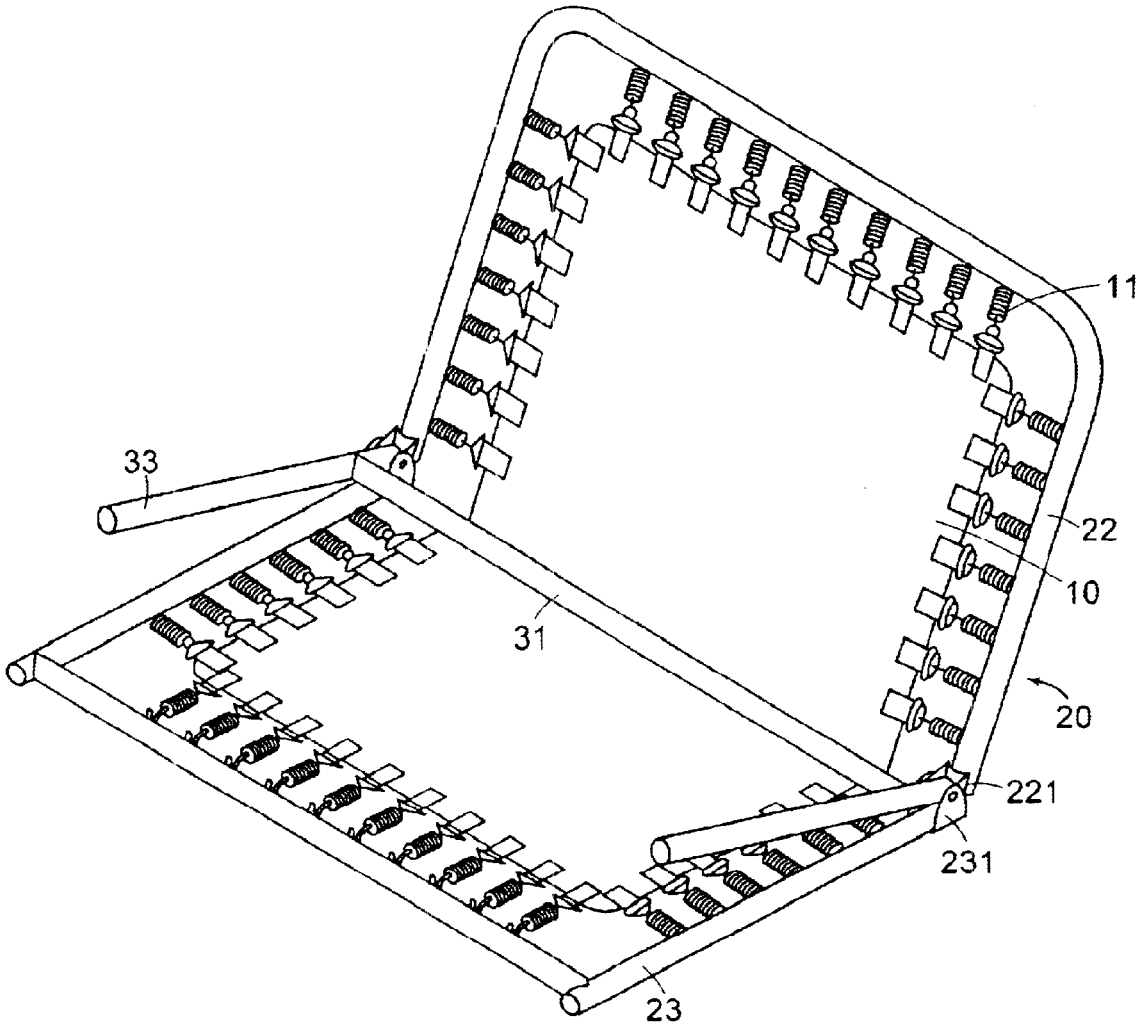
FIG. 4 is a rear isometric view of a foldable portion of the recoil wall of FIG. 1.
Figure 5:
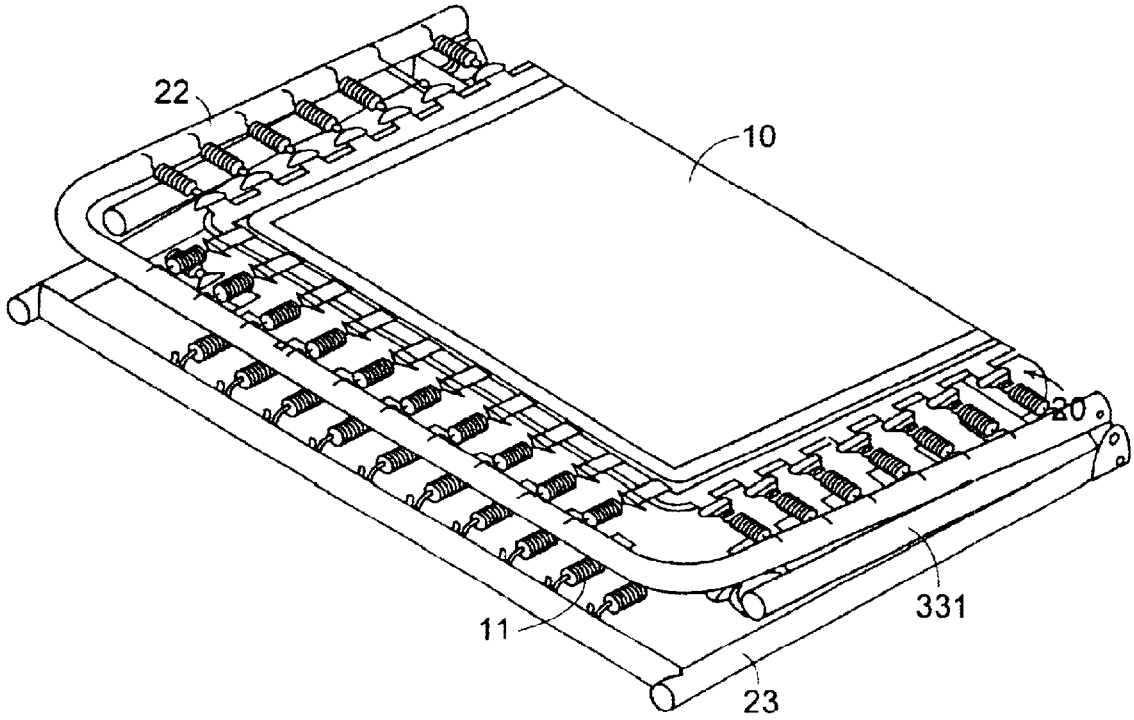
FIG. 5 is an isometric view of the foldable portion of FIG. 4, shown in a folded position.

The frame 20 may comprise a first U-shaped frame member 22 that is pivotably connected to an opposing second U-shaped frame member 23. The first and second U-shaped frame members 22, 23 may conveniently be constructed from, for example, metal or polymeric tubing materials. The first U-shaped frame member 22 may include a pair of first lugs 221 and the second U-shaped tube 23 may have a pair of second lugs 231 engageable with the first lugs 221 and be pivotally secured by a pair of bolts 24 and nuts 25 so that the frame 20 is foldable. See FIGS. 4 and 5.

The frame 20 may further include a plurality of through-holes 21 formed around its inner periphery and in registry with the projections 12 of the target 10 for connecting the target 10 inside the frame 20 by a plurality of resilient members 11, such as, for example, coil springs. However, other types of resilient members, straps, etc. could conceivably be employed. Each of the springs 11 may have a first hook 111 that hooks through a corresponding retaining ring 13 protruding from the target 10, and a second hook 112 that hooks through a corresponding through-hole 21 in the frame 20. As illustrated in FIG. 1, the frame 20 may be substantially rectangular in shape and define a central opening 20' in which the target 10 may be centrally disposed. It is conceivable, however, that the frame 20 may be provided in myriad of other shapes and define differently shaped central openings if desired.

Figure 6:
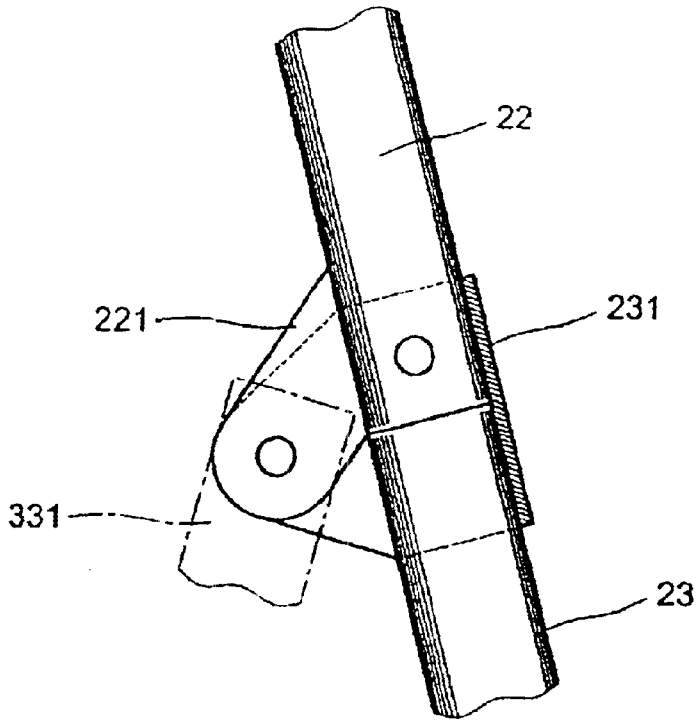
FIG. 6 is a partial isometric view of a connection of the recoil wall of FIG. 1 in an assembled position.

In this embodiment, the sustaining assembly 30 may include a first sustainer 32 that extends from the frame 20 and is removably connected to frame 20 by suitable fasteners, such as bolts, screws, etc. In one embodiment, the first sustainer 32 may be U-shaped and substantially coplanar with the frame 20 at the lower end of the frame 20. The sustaining assembly 30 may also include a second sustainer 33. The second sustainer 33 may also be U-shaped and be pivotably connected to the rear of the frame 20 so that is collapsible. The second sustainer 33 may pivot together with the first and second lugs 221 and 231 that connect the first and second frame members 22, 23. See FIGS. 6 and 7.

The first sustainer 32 may also include of a pair of straight members 321 that are removably connected to the second frame member 23 and a pair of L-shaped members 322 that are connected to each other and to the straight members 321. Each of the L-shaped members 322 of the first sustainer 32 may have a padded sleeve or other support pad 3221 on the portion that contacts a support surface or the ground. The padded sleeves 3221 may provide frictional resistance, stability and cushioned support for the recoil wall 100. Padded sleeves 3221 may be made, for example, from a variety of materials, such as foam, padded sleeves, molded rubber, etc.

The second sustainer 33 may also include of a pair of first straight members 331 that are pivotably connected to the frame 20, a pair of second straight members 332 that are pivotably connected to the first straight members 331, and a pair of L-shaped members 333 that are removably connected to the pair of second straight members 332. Each of L-shaped members 333 may have a padded sleeve 3331 of the type described above on a portion that contacts the support surface or ground.

The sustaining assembly 30 may also include at least one, or typically two, adjustable braces 34. Each brace 34 is pivotably connected to the first sustainer 32 and is selectively connectable to the second sustainer 33 in a plurality of positions to retain the frame 20 in a plurality of inclined positions. In one embodiment, each brace 34 is pivotably connected to a pair of aligned through-holes 3211 in the respective straight member 321 of the first sustainer 32 by a corresponding bolt 342. See FIG. 2.

Figure 9:
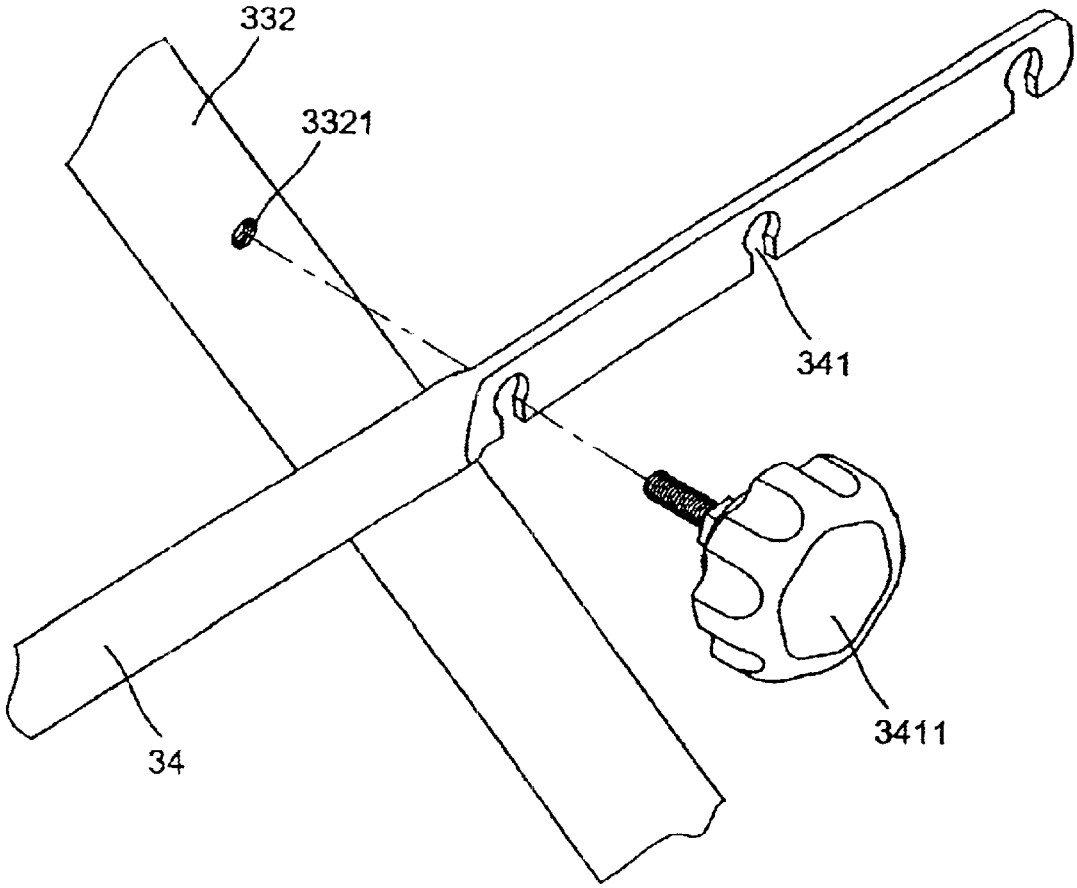
FIG. 9 is a partial isometric view of an embodiment of a connection between a sustainer and brace of the recoil wall of FIG. 1.

Each brace 34 may also have a plurality of positioning slots 341 which are alignable with a corresponding threaded screw hole 3321 in the corresponding second straight member 332 of the second sustainer 33. Each brace 34 may be selectively secured to the corresponding second straight member 332 in any one of a plurality of orientations (corresponding to the number and orientations of slots 341 provided in the brace 34) by a threaded fastener 3411, such as, for example, a thumbscrew or swivel knob screw, for adjusting the inclinations of the frame 20. As can be seen in FIG. 9, the fastener 3411 may comprise a bolt that has an adjustment knob formed thereon for easy installation. The skilled artisan will appreciate, however, that other fasteners and fastening methods may be employed to adjustably couple one end of the brace 34 to the corresponding second straight member 332 of the second sustainer 44. Thus, a plurality of different inclination angles (represented by "A" in FIG. 1) may be achieved by providing a plurality of adjustment slots 341 in the braces 34.

Figure 8:
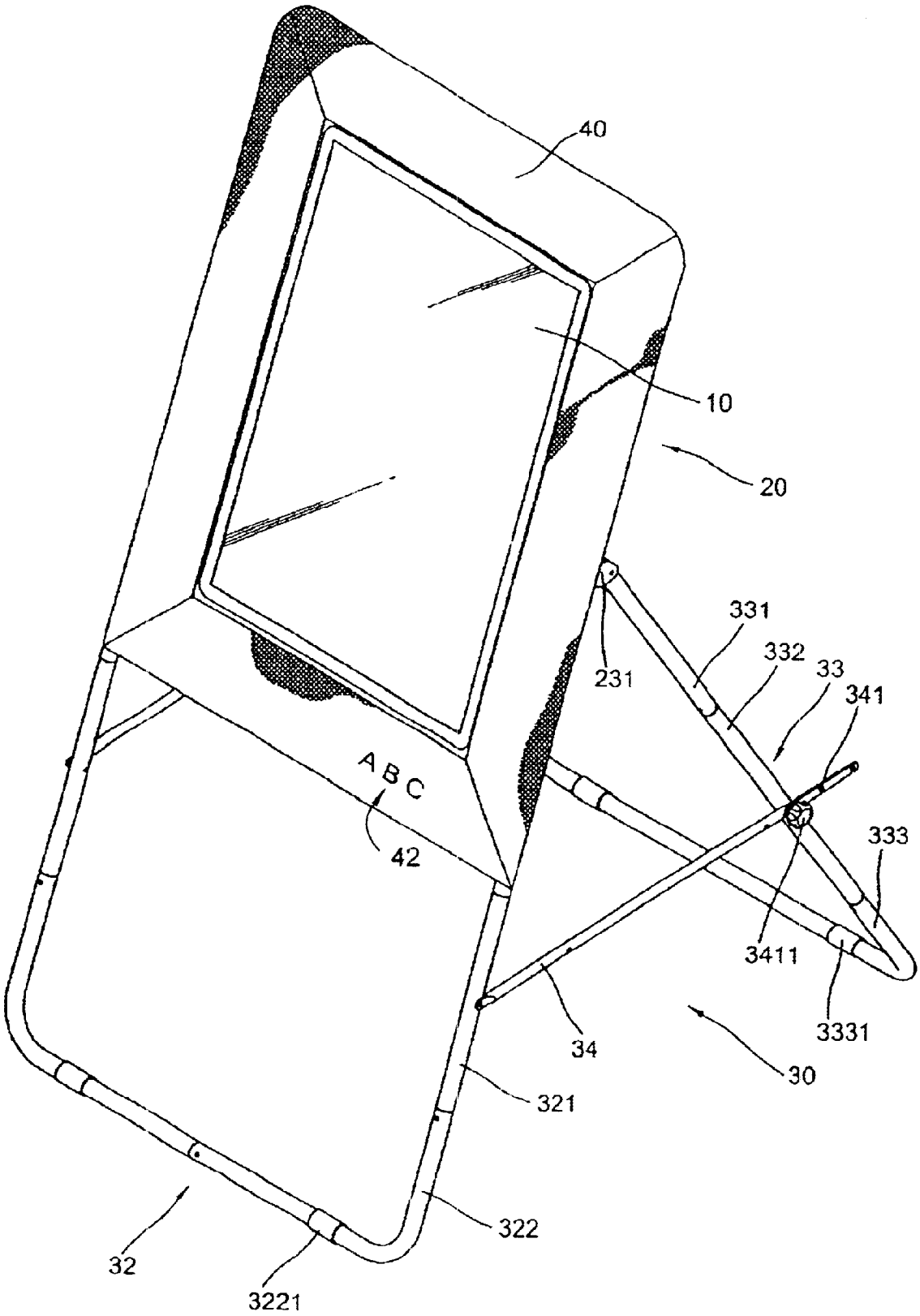
FIG. 8 is a front and right side isometric view of the recoil wall of FIG. 1, employing a cover of the present invention.

If desired, the sustaining assembly 30 may also include a transverse member 31 that extends between and interconnects the first straight members 331 of the second sustainer 33 to prevent the target 10 from moving rearward under the impact of the ball or other projectile. See FIG. 3. Also, as shown in FIGS. 1, 3, and 8, the frame 20 of various embodiments of the present invention may be constructed to support the target 10 in a variety of different target orientations depending upon the adjustability of the frame 20. As used herein, the term "target orientation" may refer to any orientation which may be particularly conducive to the type of sport being practiced and the desired angle of return of the projectile (ball, etc.) being propelled by the target to the user.

FIG. 1 illustrates an embodiment of the recoil wall 10 in a position that is ready for use. When in such position, the user is able to throw or otherwise propel the object (i.e., ball) onto the target 10. Because the target 10 is resiliently coupled to the frame 20 and, by virtue of its elastic nature (if the target 10 is fabricated from relatively elastic material), the target 10 recoils the ball back to the user. The skilled artisan will appreciate that the angle of inclination of the target may be easily adjusted by selecting different slots 341 in the braces 34 for securing the ends of the braces 34 to the second straight members 332.

Figure 7:
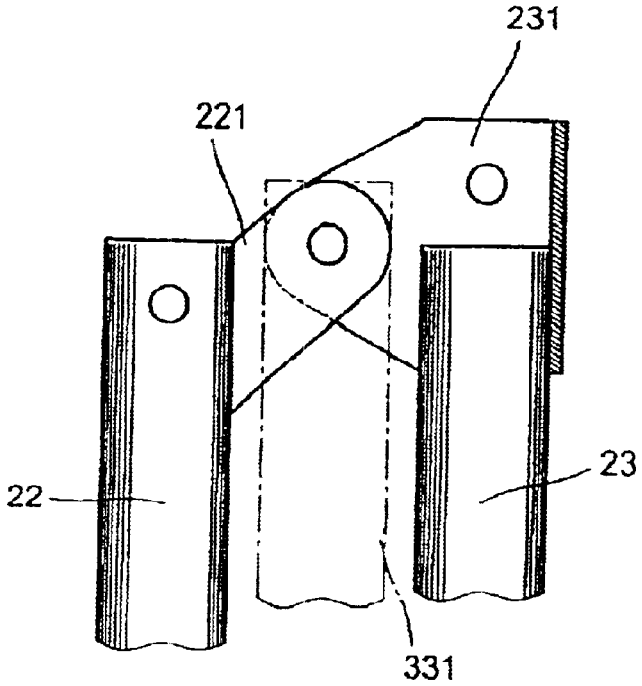
FIG. 7 is a partial isometric view of the connection of FIG. 6 in a folded position.

This embodiment of the recoil wall 100 may be partially disassembled and folded as shown in FIGS. 4–7. The first sustainer 32 may be completely removed from the frame 20 by disassembling the fasteners connecting it to the frame 20. The braces 34 may be removed together with the first sustainer 32, or may be separately disassembled. The second straight members 332, including the L-shaped members 333 of the second sustainer 33, may also be removed as one piece or separately. The frame 20 may then be folded up such that the first and second frame members 22, 23 lie in substantially superimposed parallel planes, and the first straight members 331 of the second sustainer 33 are disposed therebetween, as shown in FIG. 7. The recoil wall 100 in its folded configuration is compact and may be easily packed for transportation or storage.

Figure 10:
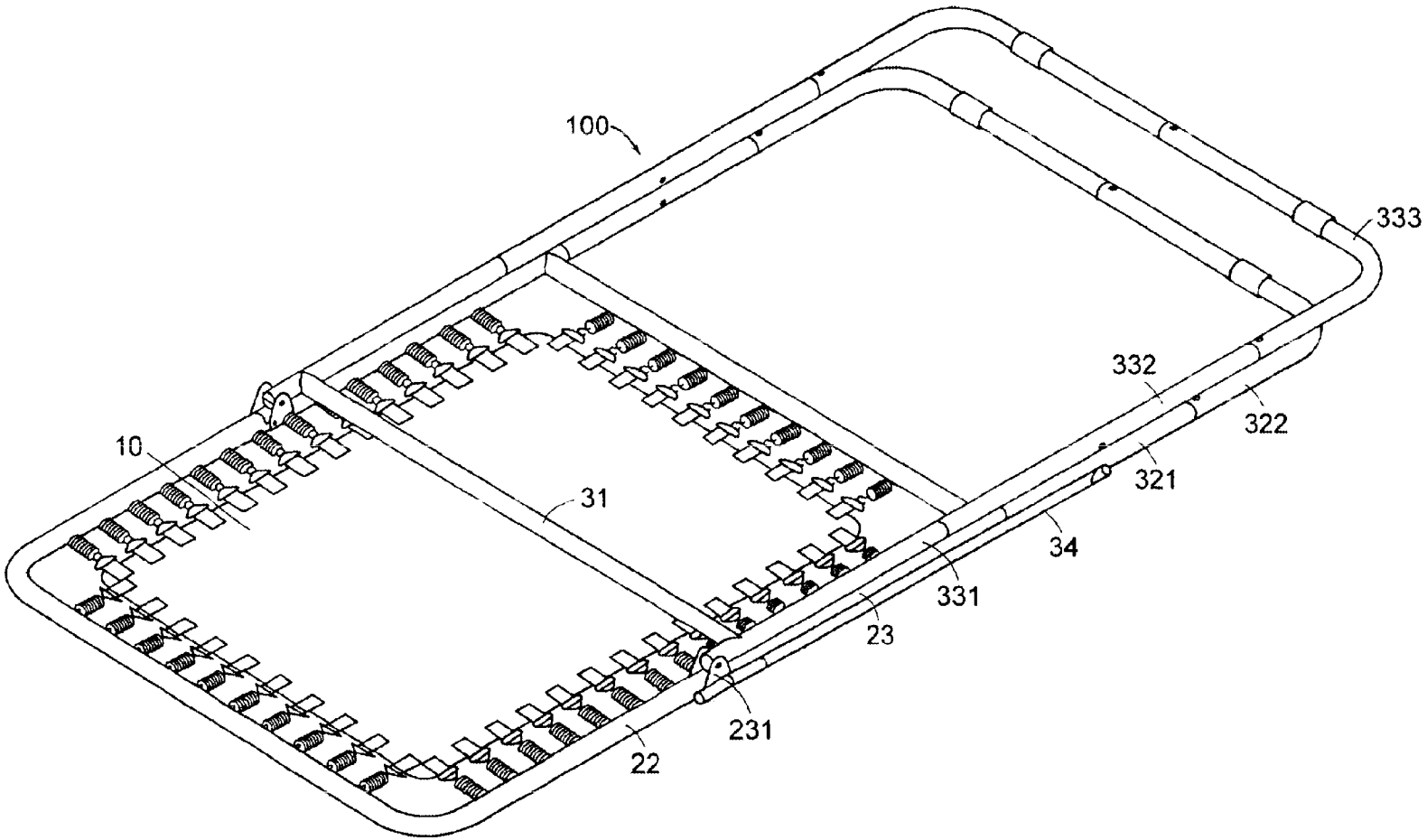
FIG. 10 is an isometric view of the recoil wall of FIG. 1, shown in a collapsed position.
Figure 11:
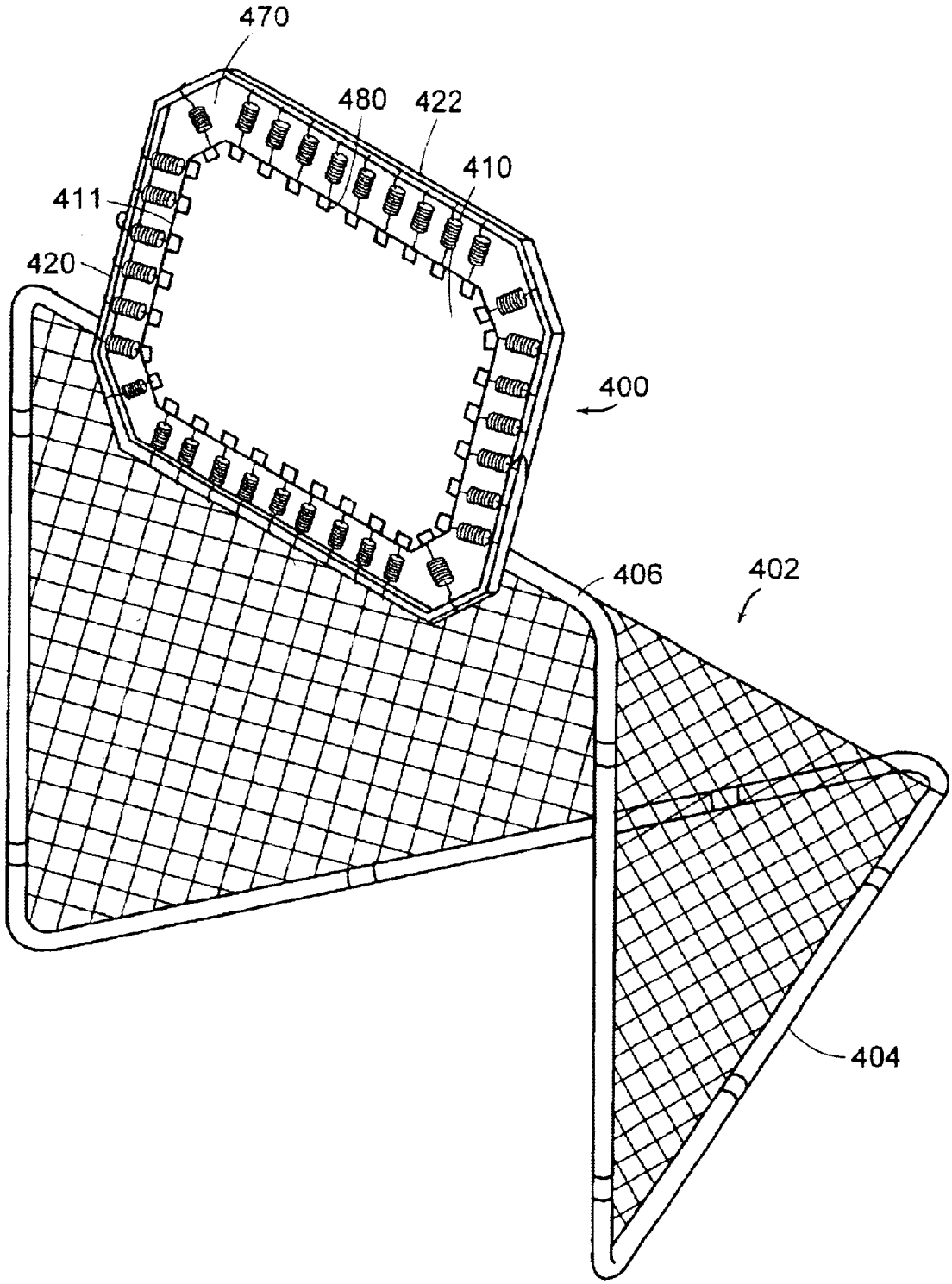
FIG. 11 is a perspective view of another recoil target embodiment of the present invention fastened to a netted support.

The recoil wall 100 may also be collapsed without disassembling or folding by releasing the braces 34 from engagement with the second sustainer 33. The sustaining assembly 30 thereby assumes a collapsed position. See FIG. 10. In this collapsed position, the recoil wall 100 may be quickly transported or stored temporarily between frequent uses without having to disassemble or fold it.

As can be seen in FIGS. 1 and 2, the plurality of springs 11 extend between the perimeter 10' of the target 10 and the frame 20 in a space generally designated as 20". In one embodiment, a wrapper 40 may be provided to cover and/or enclose the space 20" and the gaps between the springs 11 for aesthetic reasons or to prevent the ball or other projectile from passing therethrough when the projectile misses the target 10. For example, when a user throws a ball and hits the wrapper 40, the ball could still recoil back to the user. Such arrangement further eliminates the chance of a user accidentally getting pinched by a spring when manipulating or transporting the recoil wall 100.

In one embodiment, the wrapper 40 may comprise nylon material or other materials of high tensile modulus and be retained in a position on the frame 20 by, for example, elastic or other cord sewn in its periphery, or by hook and loop fasteners, or by detachable or attached clips or clamps or a variety of other fasteners. If desired, the wrapper may contain a variety of different types of indicia 42, such as, for example, a logo, designs, motivational or instructional words, etc. Likewise, various types of target indicia, bulls eyes, borders, etc. may be provided on the target 10.

Another embodiment of a portable recoil target 400 of the present invention is illustrated in FIGS. 10–18 that may be particularly useful for, for example, facilitating the practice of the throwing skills of a lacrosse player. As can be seen in these Figures, this embodiment of recoil target 400 of the present invention may be coupled to a structure such as a lacrosse goal 402 or the like. Those of ordinary skill in the art will appreciate, however, that various embodiments of the recoil target 400 of the present invention may be advantageously affixed in a desired orientation to a myriad of other structures and types of goals, etc. without departing from the spirit and scope of the present invention.

As can be seen in those Figures, one embodiment of the recoil target 400 of the present invention may include a target sheet 410 that is resiliently attached to a frame assembly 420. The frame assembly 420 may be fabricated from a variety of suitable materials such as, for example, metal tubing and/or metal structural members, polymeric tubing and/or structural members, etc. and include an inverse U-shaped upper frame member 422 and a U-shaped lower frame member 430 that are pivotally interconnected to facilitate folding of the frame assembly 420.

Figure 12:
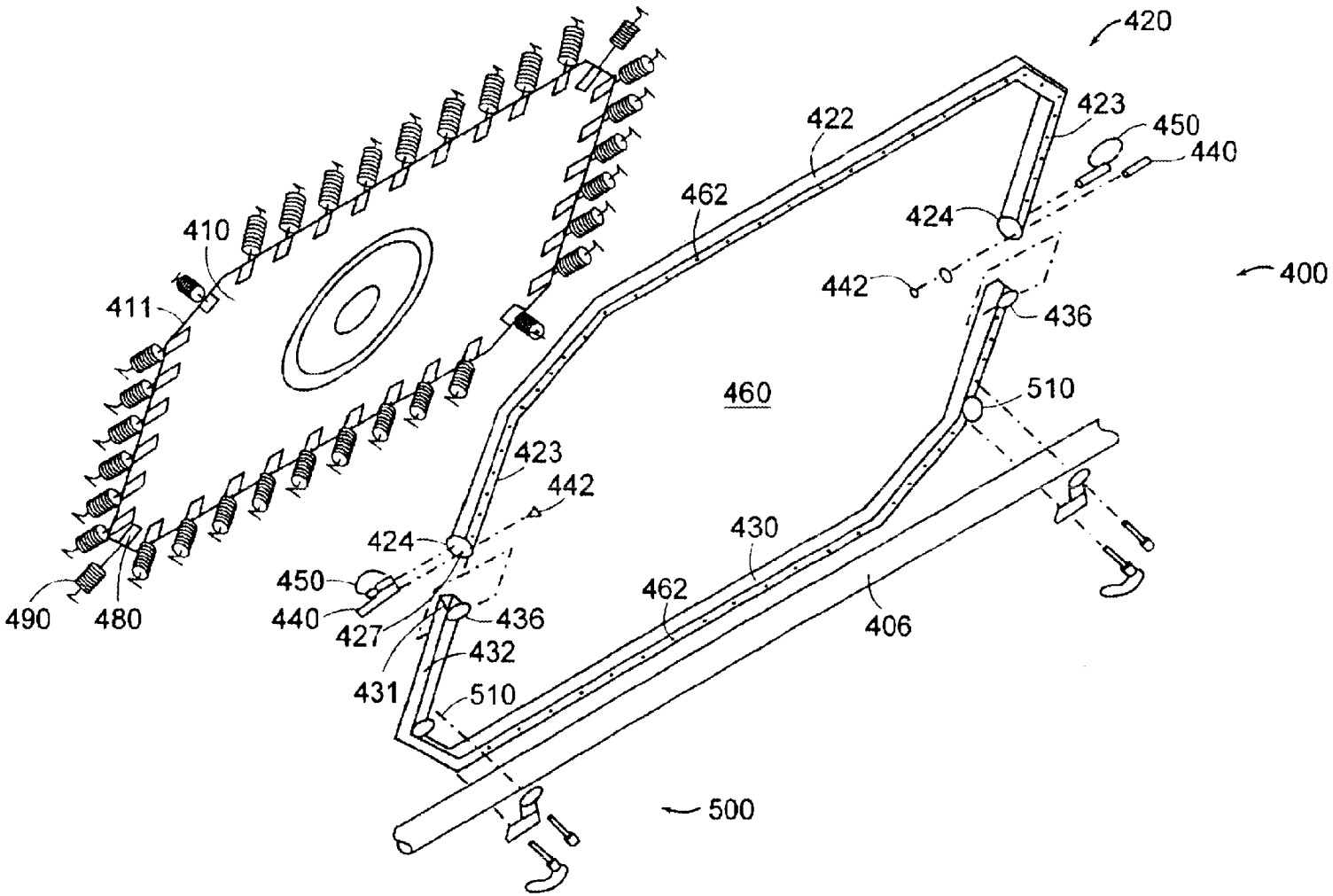
FIG. 12 is an exploded perspective view of the recoil target embodiment depicted in FIG. 11.
Figure 12A:
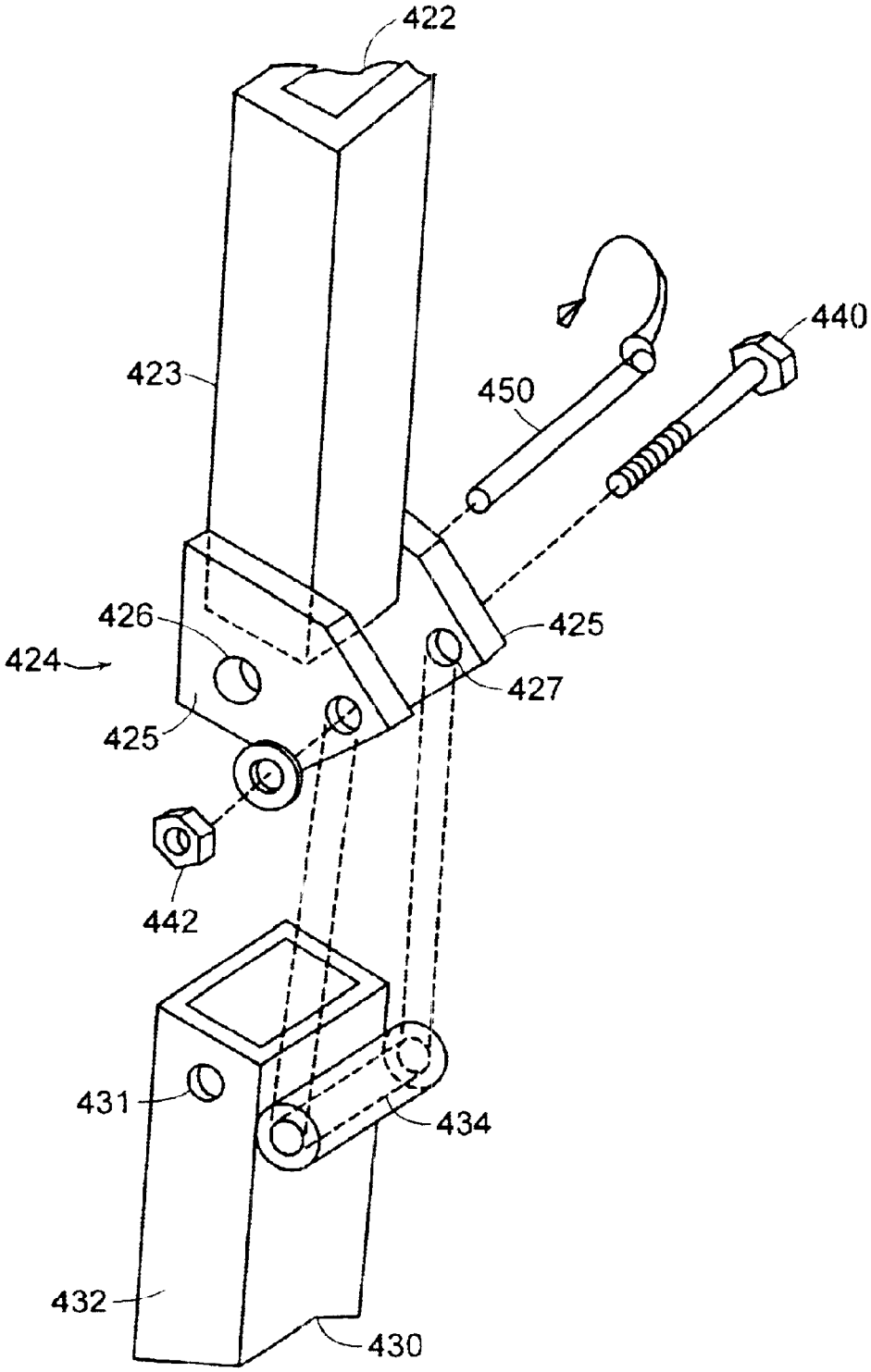
FIG. 12A is an enlarged partial perspective view of a portion of the frame assembly showing one method of coupling the upper and lower frame members together.

FIGS. 12 and 12A illustrate one method of pivotally interconnecting the upper frame member 422 and the lower frame member 430. As can be seen in those Figures, a lug assembly 424 comprising two parallel lug plates 425 may be attached to each free end 423 of the U-shaped upper frame member 422 and protrude outward therefrom. Lug plates 425 may be fabricated from material that is compatible with the frame material, such as metal, polymer, etc. and be attached to the upper frame member 422 by appropriate fastening methods such as, welding, gluing, mechanical fasteners, etc. A retaining hole 426 extends through each lug assembly 424 such that they are coaxially aligned. In addition, each lug plate 425 has a forward pivot hole 427 therethrough. The forward pivot holes 427 in the lug plates 425 of each lug assembly 424 are coaxially aligned with each other.

Figure 13:
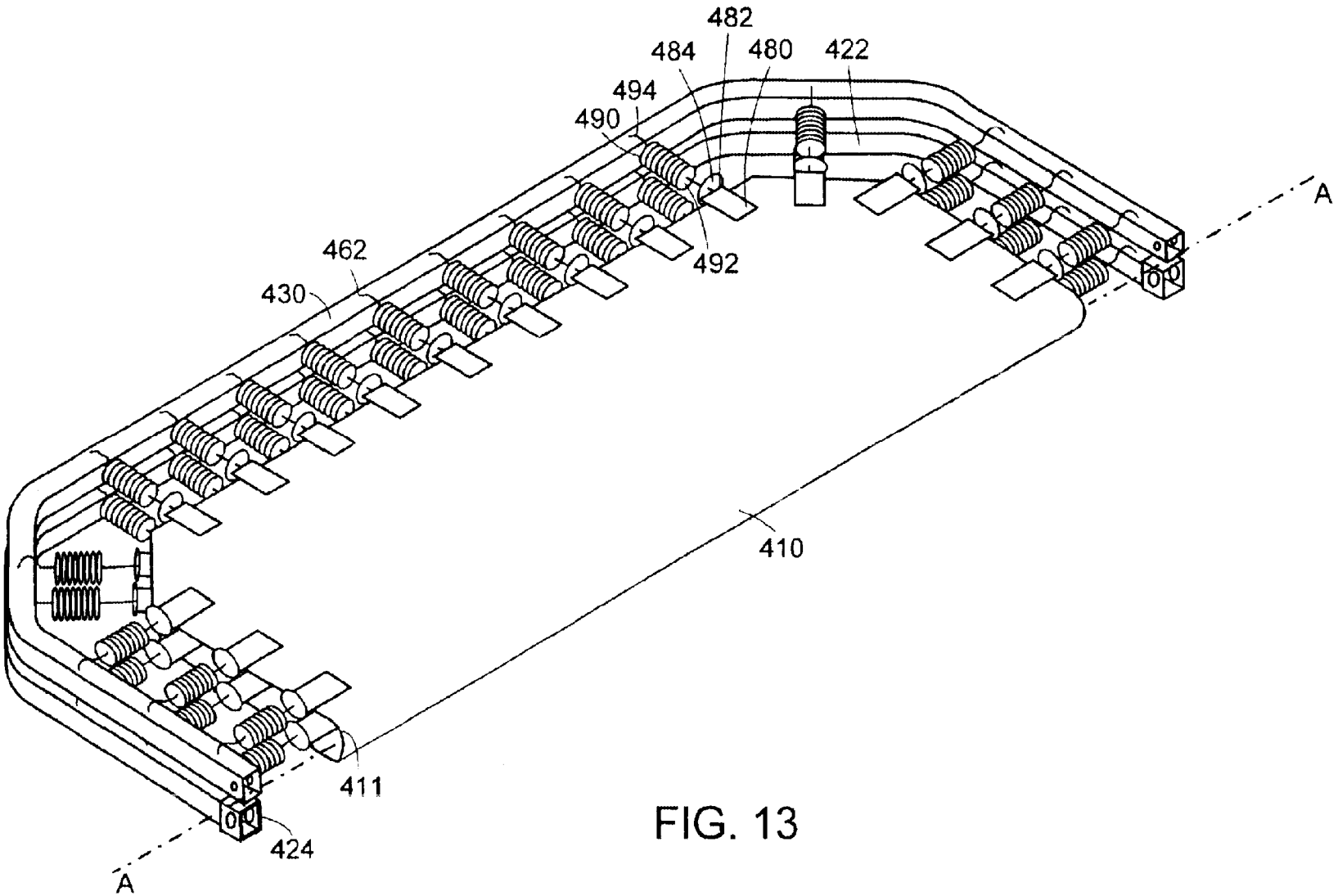
FIG. 13 is a perspective view showing the recoil target embodiment depicted in FIGS. 11 and 12 in a folded state.

As can also be seen in FIGS. 12 and 12A, a corresponding hollow pivot tube 434 is attached to a corresponding free end 432 of the U-shaped lower frame member 430. The pivot tubes 434 may be fabricated from material that is the same as or compatible with the material from which the lower frame member 430 is fabricated and be attached to the lower frame member 430 by suitable fastening methods such as, for example, welding, brazing, gluing, etc. Each pivot tube 434 has a passage 436 extending therethrough that is adapted to be coaxially aligned with the pivot holes 427 in a corresponding lug assembly 424 when the ends 423 of the upper frame member 422 and the ends 432 of the lower frame member 430 are brought together. A corresponding retaining fastener 440 such as a bolt is inserted through the aligned forward pivot holes 427 and pivot tube passage 436 and may be retained in that position by a nut 442. The reader will appreciate that such arrangement permits the upper frame member 422 and the lower frame member 430 to be pivoted relative to each other about a pivot axis designated as "A—A" between an open position (FIG. 11) and a closed or folded position (FIG. 13). To releasably retain the upper frame member 422 and the lower frame member 430 in the open position, a commercially available retaining clip 450 or other suitable fastener may be inserted through the coaxially aligned retaining holes 426, 431 in the free ends of the upper and lower frame members 422, 430, respectively. When in the open or "extended" position, the upper frame member 422 and the lower frame member 430 serve to define an open central area 460 for receiving the target sheet 410 therein. See FIG. 12. Both the upper frame member 422 and the lower frame member 430 may further have a plurality of thru holes 462 spaced accordingly and formed around their backside. It will be appreciated that the upper frame member 422 and the lower frame member 430 may be advantageously shaped so as to provide the frame assembly 420 with a desired shape when in the open position. Thus, this embodiment of the subject invention should not be limited to embodiment employing a frame assembly 420 having the particular shape depicted in FIGS. 11–18.

In one embodiment, the target sheet 410 is made of high-tension cloth of the type described above or other resilient, semi-resilient or rigid material. It will be appreciated that the target sheet 410 may be complementary shaped to match the shape of the open central area 460 of the frame assembly 420 and may be sized such that, when the target sheet 410 is centrally disposed in the open central area 460, an open area 470 extends between the perimeter 411 of the target sheet 410 and the frame assembly 420. See FIG. 11. In this embodiment, a plurality of projections 480 advantageously protrude outward from the perimeter 411 of the target sheet 410. Such projections 480 may be equally spaced around the perimeter 411 of the target sheet 410 or they may be advantageously located to provide the support necessary to cause the target sheet 410 to recoil a ball or other projectile in a desired manner. The projections 480 may be integrally formed from the target sheet 410 or they may comprise separate pieces of material fabricated from the target sheet material or similar material and be attached to the target sheet 410 by, for example, sewing or other fastening devices or methods. Each of the projections 480 may have a ring 484 on a free end 482. The target sheet 410 is disposed in the central open area 460 defined by the frame assembly 420 and connected by a plurality of resilient members 490 such as coil springs or the like. The coil springs 490 may be attached to the target sheet 410 by hooking one end 492 of the spring 490 through the ring 484 of the projections 480 and hooking the other end 494 of the spring 490 through a corresponding thru hole 462 in the back side of the upper and lower frame members 422, 430, respectively. See FIG. 13.

To facilitate removable attachment of the recoil target 400 to a portion of a goal 402 such as a lacrosse goal, removable attachment or clamping assemblies 500 may be provided on the frame assembly 420. In the embodiment depicted in FIGS. 11 and 12, the lacrosse goal 402 has a tubular frame 404 that that has a tubular goal upper crossbar 406. The embodiment depicted in FIGS. 11 and 12, employs removable attachment assemblies 500 that are particularly well suited for attaching the recoil target 400 to the upper crossbar 406 of the goal 402. Those of ordinary skill in the art will appreciate, however, that other fastener arrangements tailored for attachment to a particular type of goal or other structure such as, for example, a wall, pole, tree, etc. may be employed without departing from the spirit and scope of the present invention.

Figure 14:
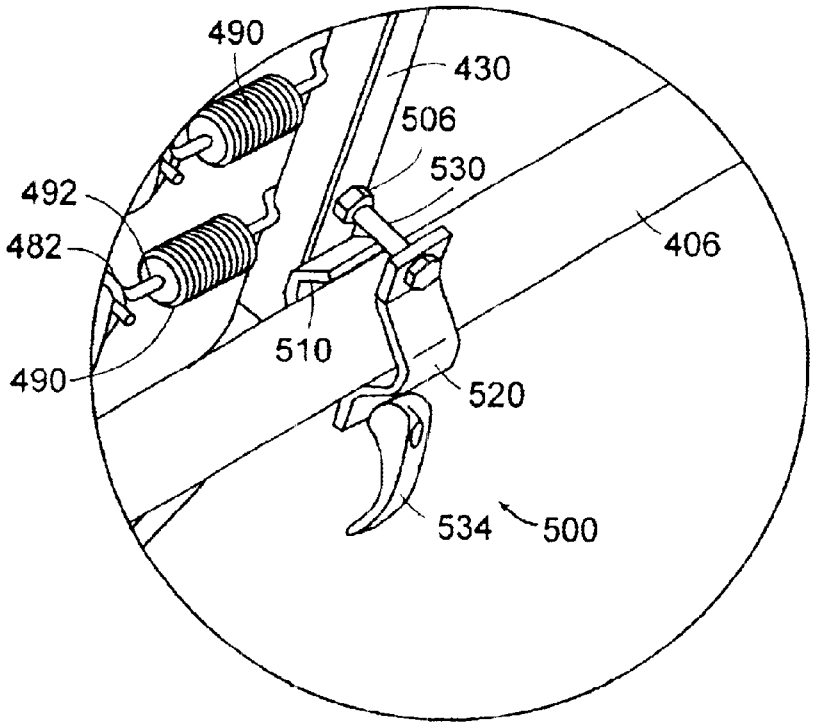
FIG. 14 is a partial perspective view showing one clamping arrangement for clamping the target sheet thereof to the frame.
Figure 15:
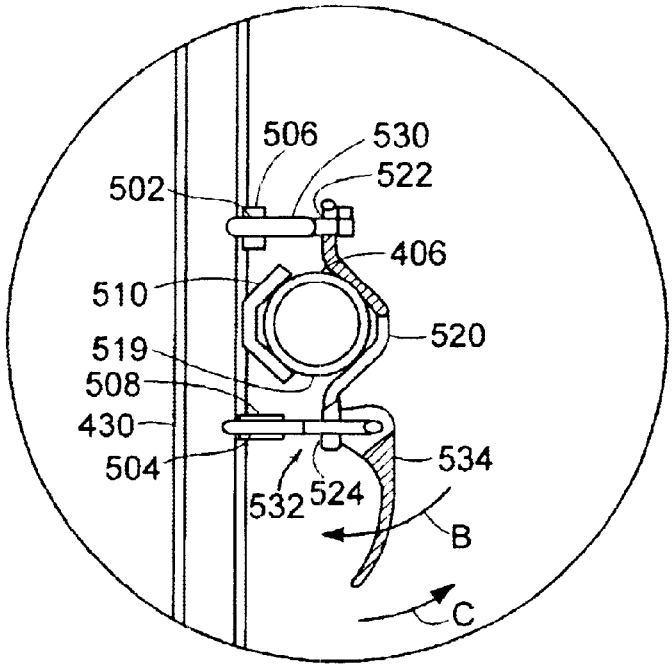
FIG. 15 is a partial cross-sectional view of the clamping arrangement depicted in FIG. 14.

Referring to FIGS. 12, 14, and 15, a pair of fastener holes 502, 504 are spaced uniformly and provided through portions of the lower frame member 430. In one embodiment, depending upon the thickness of the material comprising the lower frame member 430, the fastener holes 502, 504 may be threaded. In the embodiment depicted in FIGS. 12, 14, and 15, separate threaded fasteners 506, 508, such as nuts may be affixed to the lower frame member 430 in alignment with the fastener holes 502, 504, respectively, by, for example, welding, gluing, etc. Centrally disposed between the nuts 506, 508 is a first V-shaped retaining plate 510. The V-shaped retaining plates 510 may be attached to the lower frame member 430 by welding, gluing, mechanical fasteners, etc. A corresponding pair of second V-shaped retaining plates 520 are made to cooperate with the first V-shaped retaining plates 510 to clamp the lower frame member 430 to the crossbar 406 of the goal 402 in the manner depicted in FIGS. 12, 14, and 15.

More particularly, each second V-shaped retaining plate 520 has a pair of spaced holes 522, 524 therethrough, such that, when the V-shaped second plates 520 are placed in registry with the corresponding V-shaped first plates 510 as shown in FIG. 15, they serve to define an area 519 for gripping a portion of the cross bar 406 therein and such that the hole 522 is in alignment with nut 506 and the hole 524 is in alignment with the nut 508. To affix the recoil target 400 to the goal 402, the upper crossbar 406 of the goal 402 is placed between the first and second plates 510 (in area 519), 520 as shown in FIGS. 14 and 15 and a first threaded fastener 530 extends through hole 522 to be threadly received in nut 506. In addition, a rapid retaining bolt 532 extends through hole 524 and is threadedly received in the nut 508 to fasten the other end of the second V-shaped retaining plate 520 to the lower frame member 430. The rapid retaining bolt 532 has a wedge lever 534 eccentrically pivoted to its outer end. When the wedge lever 534 is pivoted in the direction represented by arrow "B" in FIG. 15, the second V-shaped retaining plate 520 is drawn in towards the first V-shaped retaining plate 510 to clampingly retain the crossbar 406 therebetween affixing the recoil target 400 to the netted goal 402.

Figure 16:
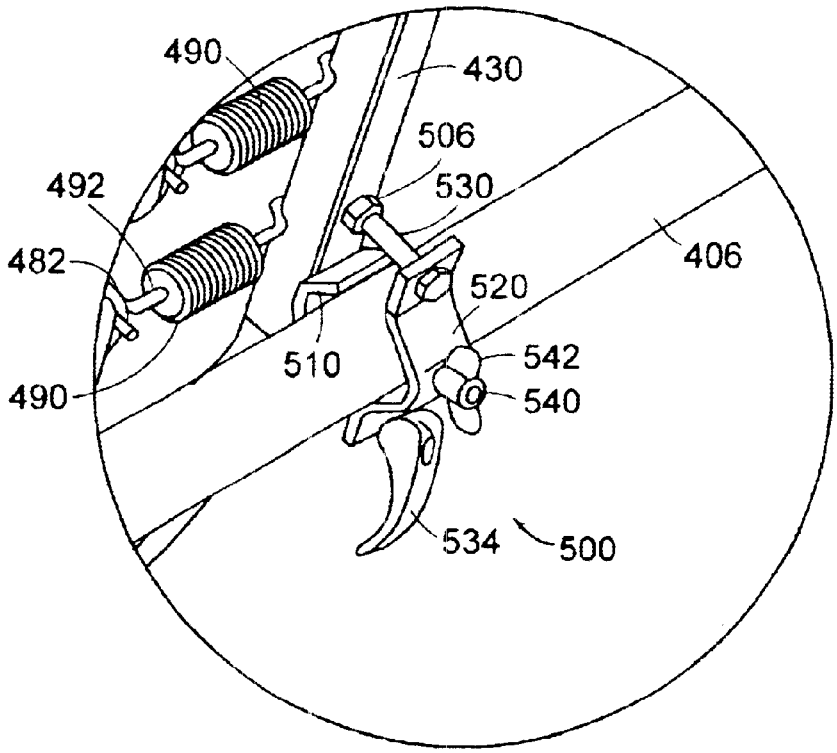
FIG. 16 is a perspective view of the clamping arrangement of FIGS. 14 and 15 including a bolt and a wing nut arrangement.
Figure 17:
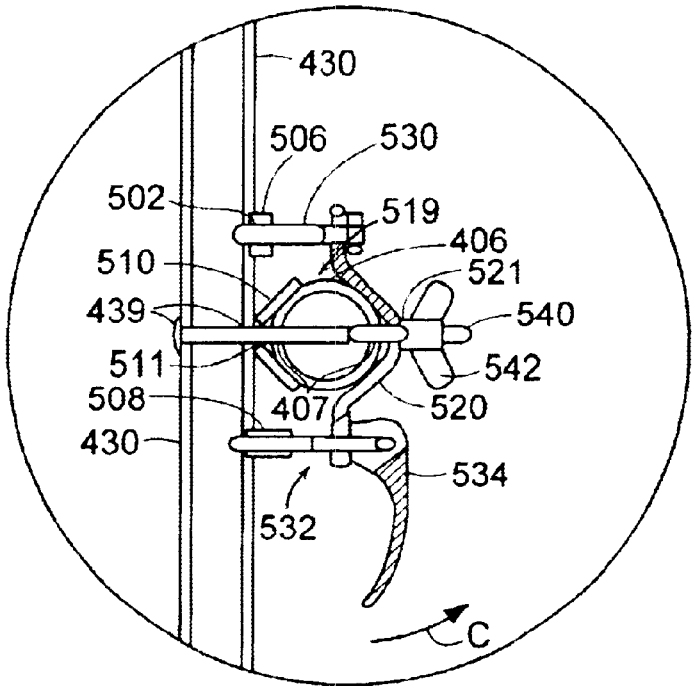
FIG. 17 is a sectional view of the arrangement depicted in FIG. 16.

In another embodiment, a locking bolt 540 may be inserted through aligned holes 439 in the lower frame member 430, a hole 511 in the first V-shaped retaining plate 510, holes 407 in the upper crossbar 406 and a hole 521 in the second V-shaped retaining plate 520 as shown in FIGS. 16 and 17. A wing nut 542 may then be affixed to the bolt 540 to retain it in position. This arrangement serves to prevent the rotation of the recoil target 400 on the goal 402 under a hard throwing of the ball or other projectile.

To remove the recoil target 400 from the goal 402, the nuts 542 are loosened and the bolts 540 are removed. The wedge lever 534 is pivoted outward (in the "C" direction) to permit the crossbar 406 to be removed from between the first and second V-shaped retaining plates 510, 520, respectively. Also, by removing the retaining pins 450, the recoil target 400 is foldable. See FIG. 13. The recoil target 400 accepts its small volume and is easily folded up to pack for transportation; it also can be fastened onto a cylindrical object indoor or outdoor without a separate support structure.

Figure 18:
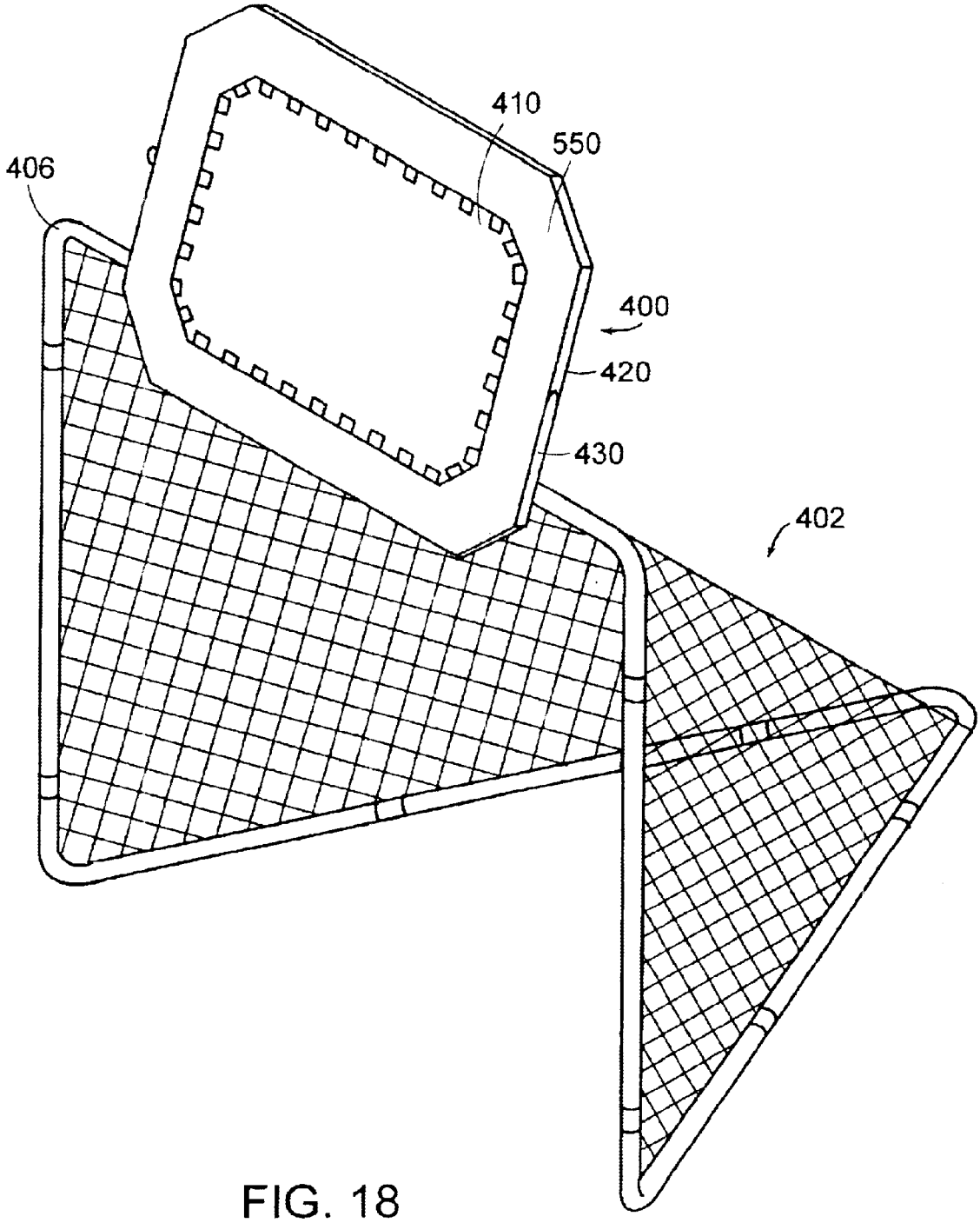
FIG. 18 is a perspective of one embodiment of the recoil target of the present invention view to show a cover disposed between the target and the frame.

Referring to FIG. 18, a cover 550 of the type and construction described above may be useful to cover the gap 470 between the elastic target 410 and the frame assembly 420. When a ball hits the gap 470, it will not go through but also recoil back to the player. Cover 550 may be retained in position by, for example, elastic straps, hooks or both.

Thus, as may be appreciated from the foregoing, various embodiments of the present invention are well-suited for recoiling or returning projectiles (balls, pucks, etc.) that are thrown, hit, bounced, etc. into the target of the recoil wall. For example, certain embodiments of the present invention are particularly well suited for practicing ball throwing and stick handling skills required when playing the sport of lacrosse. However, those of ordinary skill in the art will readily appreciate that various embodiments of the subject invention may be employed to practice throwing and/or catching skills associated with a variety of other sports activities, such as baseball, softball, hockey, etc. The reader will also readily appreciate that various embodiments of the subject invention are easy to assemble and disassemble for portability purposes. Such unique and novel features make these embodiments well adapted for use indoors or outdoors. Furthermore, various embodiments of the present invention may be easily removably attached to a variety of different structures and sports goals to support the target in a desired location and orientation.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the spirit invention. The preceding description, therefore, is not meant to limit the scope of the invention. Rather the scope of the invention is to be determined only by the appended claims and their equivalents.

What is claimed is:

1. A recoil wall comprising:

a coplanar assembly including a target resiliently supported by a foldable frame and a first sustainer coupled to said foldable frame in a substantially coplanar relationship with respect to said foldable frame;

a collapsible second sustainer pivotably connected to and extending rearward from said foldable frame, said second sustainer including a pair of first straight members pivotably connected to said foldable frame, a pair of second straight members removably connected to said pair of first straight members respectively, and a pair of interconnected L-shaped members removably connected to said pair of second straight members respectively; and at least one removable brace pivotably connected to said co-planar assembly and selectively connected to said second sustainer in a plurality of positions to retain said foldable frame in any one of a plurality of inclined positions.

2. The recoil wall of claim 1, wherein said foldable frame comprises a first U-shaped frame member pivotably connected to an opposing second U-shaped frame member.

3. The recoil wall of claim 1, wherein said first sustainer is removably coupled to said foldable frame.

4. The recoil wall of claim 1, wherein said target comprises a piece of elastic cloth centrally supported in a central open area defined by said foldable frame by a plurality of resilient supports coupled to said piece of elastic cloth and said foldable frame.

5. The recoil wall of claim 1, wherein said target is connected to said foldable frame by a plurality of springs.

6. The recoil wall of claim 1, wherein said first sustainer comprises a pair of straight members connected to said foldable frame and a pair of interconnected L-shaped members connected to said straight members.

7. The recoil wall of claim 1, wherein said first and second sustainers are tubular.

8. The recoil wall of claim 6, further comprising a transverse member interconnecting said first straight members.

9. The recoil wall of claim 1, wherein said brace includes a plurality of slots for selectively receiving a corresponding fastener protruding from a corresponding one of said pair of second straight members.

10. The recoil wall of claim 9, wherein said fastener comprises a threaded thumbscrew.

11. The recoil wall of claim 1, wherein said foldable frame comprises a first U-shaped frame member hingedly connected to an opposing second U-shaped frame member.

12. The recoil wall of claim 11, wherein said first and second frame members are tubular.

13. The recoil wall of claim 6, wherein said target is resiliently supported within a central opening defined by said foldable frame.

14. The recoil target of claim 13, wherein the target is centrally disposed within said central opening such that an open area extends between a perimeter of said target and said foldable frame.

15. A The recoil wall of claim 14, further comprising a plurality of resilient members coupled to said target around the perimeter thereof and coupled to said foldable frame.

16. The recoil wall of claim 15, wherein said plurality of resilient members comprises a plurality of coil springs.

17. The recoil wall of claim 16, wherein each said spring has a first hook for attachment to said target and a second hook for attachment to said foldable frame.

18. The recoil wall of claim 17, wherein said first hook of each said spring is coupled to a corresponding projection protruding from said perimeter of said target.

19. The recoil wall of claim 18, wherein eat said projection is an integral part of said target.

20. The recoil wall of claim 14, further comprising a wrapper covering said open area extending between said perimeter of said target and paid foldable frame.

21. The recoil wall of claim 20, further comprising indicia on said wrapper.

22. The recoil wall of claim 1, further comprising at least one support pad on at least one of said first and second sustainers.

* * * * *